US008226883B2

(12) United States Patent
Koeck et al.

(10) Patent No.: US 8,226,883 B2
(45) Date of Patent: Jul. 24, 2012

(54) SYSTEM AND METHOD FOR HARDENING RAILS

(75) Inventors: Norbert Koeck, St. Peter Freienstein (AT); Hans Pfeiler, Leoben (AT)

(73) Assignee: voestalpine Schienen GmbH, Leoben (AT)

( * ) Notice: Subject to any disclaimer, the term of this patent is extended or adjusted under 35 U.S.C. 154(b) by 582 days.

(21) Appl. No.: 12/364,877

(22) Filed: Feb. 3, 2009

(65) Prior Publication Data

US 2009/0200713 A1 Aug. 13, 2009

(30) Foreign Application Priority Data

Feb. 4, 2008 (AT) ..... A 175/2008

(51) Int. Cl.
*C21D 1/00* (2006.01)

(52) U.S. Cl. ..... 266/112; 266/133

(58) Field of Classification Search ..... 266/44, 266/112, 130, 132, 133
See application file for complete search history.

(56) References Cited

U.S. PATENT DOCUMENTS

| | | | | |
|---|---|---|---|---|
| 5,054,746 | A | 10/1991 | Buchegger | |
| 6,432,230 | B1 | 8/2002 | Kock et al. | |
| 6,689,228 | B2 | 2/2004 | Köck et al. | |
| 2003/0047852 | A1 | 3/2003 | Kock et al. | |
| 2009/0200713 | A1 * | 8/2009 | Koeck et al. | 266/44 |

FOREIGN PATENT DOCUMENTS

| | | | |
|---|---|---|---|
| AT | 410 549 B | | 5/2003 |
| EP | 0 441 766 | * | 8/1991 |
| EP | 0 441 776 | | 8/1991 |
| EP | 1 160 341 | | 12/2001 |
| GB | 266 730 | | 12/1927 |

* cited by examiner

*Primary Examiner* — Scott Kastler

(74) *Attorney, Agent, or Firm* — Greenblum & Bernstein, P.L.C.

(57) ABSTRACT

System and method for hardening rails by cooling, in a cooling medium, at least one part of a respective rail cross-section of a rail over an entire length of the rail. The system includes a cross displacement device arranged in an area of a roller table, at least one positioning device, at least one coolant container containing the cooling medium, a manipulation gripper comprising a plurality of pincers and being structured and arranged to move the rail. The method includes at least one of moving the rail from the roller table to the at least one coolant container positioning the rail into the at least one positioning device via the manipulation gripper, as well as moving the rail into the coolant medium with the at least one positioning device.

10 Claims, 3 Drawing Sheets

SYSTEM AND METHOD FOR HARDENING RAILS

CROSS-REFERENCE TO RELATED APPLICATIONS

The present application claims priority under 35 U.S.C. §119 of Austrian Patent Application No. A 175/2008, filed Feb. 4, 2008, the disclosure of which is expressly incorporated by reference herein in its entirety.

BACKGROUND OF THE INVENTION

1. Field of the Invention

The invention relates to a system and method for hardening rails. The rails can be profiled rails and can have different cross-sectional forms or shapes. The rails can also have a length of greater than about 50 meters. At least one part of the rail cross section is cooled over the entire rail length in a cooling medium. The system can utilize a cross displacement device arranged in an area of a roller table as well as an adjusting device and/or a manipulation gripper for moving the rail. At least one positioning device is also utilized. The system also includes at least one tank or trough which contains the cooling medium and a cooling bed.

2. Discussion of Background Information

Rails made of steel materials containing carbon, such as low-alloyed steels, are typically subjected to rolling and are then moved onto a cooling bed and allowed to cool. These rails throughout have a pearlitic structure and corresponding mechanical properties. In order to reduce wear on the rail, in particular, when the rail experiences with high axle loads as well as when the rail sill support high speed trains in narrow curves, it is known in the prior art to adjust the fine structure using a special thermal treatment such that at least the stressed rail head portion of the rail is provided with high hardness, high abrasion resistance, and can resist crack initiation, i.e., the rail in the track has improved wearing qualities.

A device for hardening rails which produces rails with fine structure can be achieve with cooling that utilizes a pass through a spray cooling device or which utilizes immersion in a cooling medium.

Although as a rule, continuous-pass spray cooling installations used for rail hardening are structured in a simple manner, they have the disadvantage of having large space requirements as well as requiring complex technology. Such systems also cannot efficiently rule out undesirable fluctuations in the quality of the rails in production. Furthermore, the precise coordination of cooling when rails have different cross-sectional profiles (switch rails, channel rails, bull-headed rails and the like), often cannot be carried out to the extent necessary using a continuous-pass spray device. Furthermore, a delay in the cooling of cross-sectional areas in the pass through can lead to uneven cooling medium impingements and thus to fluctuations in the hardness of the material over the length of the rail.

Spray tempering of the rail in order to leave it unmoved or to displace it alternately only slightly, preferably by the respective spray device spacing, has been proposed.

Furthermore, it is known to utilize one or more dipping baths for thermal tempering of rails and/or of parts of the cross section of rails.

In the area of sequential production of hardened rails with high rolling capacity, it has been proposed in AT 410 549 B to arrange at least two fluid cooling devices respectively parallel to an alignment means and to provide cross transport means with rolling stock support elements between the roller table rollers in order to carry out a movement of a rail from the roller table to manipulators of the cooling device. The rails are subsequently moved to the bearing area of a cooling bed. An increase of the throughput rate of rails through the tempering installation can be achieved in this manner. However, a running out from the roller frame, an alignment and a rotation of the rail on the roller table is not unrestrictedly possible with active alignment means.

SUMMARY OF THE INVENTION

The invention aims to eliminate one of more of the disadvantageous noted above. The invention also relates to a system and method device of the type mentioned above for hardening rails, in particular profiled rails, wherein high-quality rails can be produced very safely and economically with a high throughput.

According to one non-limiting embodiment, the invention can preferably utilize a manipulation gripper providing an unimpeded rapid movement of the rails running out of the rollers. This renders possible an axial alignment of the rails and effects a dimensionally accurate placement of the rails in a positioning device and/or a placing of the rails on a transfer device and/or on a cooling bed. The invention can also preferably utilize a positioning device which can provide a warp-free clamping and/or a quenching device which can be used in a manner interacting with a positioning device. The invention can also utilize a control, through which the system components can be coordinated with one another, in order to provide for cyclic immersion of the head and/or other parts of the cross section of the rail (and/or the entire surface of the rail) in the course of the cooling thereof.

The manipulation gripper can include pincers that have gripping arms. The gripping arms can in turn include centering parts which ensure axial alignment of the head portion of the rail and gripping parts for holding the rail foot in a cross-sectionally aligned manner. A dimensionally accurate insertion of the rail into the positioning device and a fixing of the same therein is thus rendered possible.

The advantages that are achieved with a manipulation gripper according to the invention essentially relate to the aligned pincers thereof have gripping arms with centering parts and gripping parts whereby the rail can be aligned directly after the last roll pass and after it runs out at the roller table in the rolling heat. That is, while the rail remains in the ductile or largely plastic state. By closing the pincer parts, the rail can be aligned first in an axially manner on the head side, whereupon a cross-sectionally aligned holding of the rail foot occurs. As a result, the rails, after axial rotation of the same kind, can be inserted into a positioning device or laid on a cooling bed. This type of rail insertion into a positioning device horizontally directs and aligns the hanging foot portion of the rail. This has the advantage that, in this the position, the rail foot is always present in the same manner. Furthermore, the constant positioning of the rail can also be ensured with asymmetrical cross-sectional profiles.

The pincers are also preferably rotatable about a joint axis at least with an angular amount simultaneously in the same direction. This allows the pincers to be able to align rails on the head side from different roller table positions, e.g., from a horizontal position, to hold them in a cross-sectionally aligned manner, and to bring them into a positioning device in a dimensionally accurate manner through axial rotation.

In the course of moving or transferring the rail out of the positioning device, the rail can be advantageously deposited, via rotation of the pincers, in a desired cross-sectional position on a transfer arrangement and/or on a cooling bed.

Moving the aligned rails with (advantageous) high precision can be carried out in a short time if the manipulation gripper utilizes more than two pincers for every 10 meters of tank length.

It is favorable, both technologically and with respect to ensure proper alignment and gripping, if the pincers each and/or all have one gripping arm that can be moved or adjusted in the same manner.

Advantageously, the manipulation gripper and the associated movement arrangement are spaced apart by more than a greatest rail height (providing a clearance of movement over the rails). The manipulation gripper should also be transversely moveable above the roller table. Preferably, only the gripper arms of the pincers (in part) are lowered vertically between the rollers of the roller table to receive or grip the rail. It is also advantageous if an impingement of the roller table area with rails running out of the rollers remains unobstructed with respect to a simultaneous movement of rails in the hardening device. This ensures high flexibility and productivity of the same as well as high throughput.

The invention also relates to a system and/or method for hardening rails in that the positioning device has a plurality of horizontally aligned holding components utilizing fittings for the foot of a rail when inserted in a hanging manner. The rail foot can thus be fixed and/or supported horizontally on the fittings via detachable clamping elements and/or hold-down devices. The rail, and particularly the rail foot, can thus be secured against distortion in the axial direction of the rail.

The advantages achieved with the positioning device according to the invention include and/or result from the holding components being aligned horizontally with great precision and because they utilize two fittings and two hold-down devices. In this manner, a rail provided (from the rolling heat) with an austenitic structure is inserted by a manipulation gripper (while axially aligned) in a specific desired position into the holding components which utilize respectively two fittings for the foot of the rail. By respectively utilizing two clamping elements, the rail is secured against displacement and twisting. This securing of the rail means that the rail is retained with high precision even when great forces are involved, e.g., such as occur during a cooling phase of the rail head. The holding components, and particularly the hold-down devices or clamping elements for the rail foot, are arranged in the longitudinal extension or area of the positioning device respectively in the same manner. As a result, no or minimal bending moments are produced during the fixing or securing of the rail.

It has proven to be advantageous if both sides of the rail foot are held immovably by a fitting and a detachable clamping element of a component of the positioning device. Other fittings and elements of the respective components of the positioning device can, however, permit a displacement in the longitudinal direction of the rail. The rail can thereby also be stabilized in a desired cross-sectional position during the cooling or heat treatment. As a result, the shortening due to the material contraction occurs via a displacement that is free from any resulting surface damage.

The invention also relates to a system and method for hardening rails which utilizes at least two tanks arranged with positioning devices and positioned horizontally next to one another in an axially parallel manner and at the same level. The part of the cooling medium that can be used for rail hardening can have a depth (in the tank) that exceeds the height of the greatest rail profile by at least 10%.

The advantages of this feature of the invention can result in high productivity, and in particular, flexibility. The hardening device also preferably utilizes two tanks that are arranged axially parallel to one another as well as controllable positioning devices that can be, by way of non-limiting example, utilized for sequential cooling over a full circumference and/or for cooling only specific parts of the cross section of the rail. For example, the system can be used to exclusively cool the head or the bearing surface of a rail in the cooling medium. It is also possible, utilizing the system according to the invention, to use a plurality of immersion parameters for the rails in the cooling medium during the hardening thereof, and thus to achieve a desired structural distribution over the rail cross section.

According to a preferred embodiment of the invention, the tank has, on its base, at least one cooling medium inlet for ever 1.5 meters of tank length. The regulated cooling medium flow can be fed through these inlets. At least one plate is arranged in the tank. Preferably, the plate is perforated or allows fluid flow there-through and is arranged in the tank above the cooling medium inlets and at a distance therefrom. A plate with nozzles or channels is preferably arranged downstream in the flow direction of the cooling medium.

Through these measures, according to the invention, the local cooling intensity of the cooling medium used for cooling the cross-sectional surface areas above the rail longitudinal extension can be maintained, and, as a result, a desirable high constant quality can be achieved in the production of hardened rails.

If, according to one embodiment of the invention, a drainage system (or feed lines) for draining the cooling medium is arranged in the tank, the drainage system can be opened to briefly empty the tank. For example, in the event of a fault, the cooling medium can be removed from the tank in the shortest time possible via the drawing system. The rail hardening can thus be interrupted or halted. This interruption of hardening provides functions to protect the system and makes it easier to remove the rail held in the tank in the event of a system fault.

The invention also relates to a system for hardening rails which can utilize differently effective local cooling intensities over a cross section of the rail. This can be facilitated by using a tank as well as fittings and detachable clamping devices for clamping the foot of the hanging rail. The later devices are preferably components of the positioning device used to introduce the rail into the cooling medium. The positioning device can move the rail vertically and utilizes components that move vertically relative to one another in a controlled manner. The positioning device can also move to a vertical holding position whose duration in such a position can be adjusted.

Advantageously, desired structural embodiments of the rail as well as structural areas of the rail having different microstructures over their cross section, can be achieved. Furthermore, the rails can be produced with a quality profile that is advantageous for particular stress requirements.

In order to be able to optimize a head hardness and the distribution of the mechanical material properties over the cross section of the rail(s) (especially when the rails have different cross-sectional profiles), the fitting and clamping devices of the system configured to securely retain the foot of the hanging rail, as well as other components of the positioning device, are preferably adjustable horizontally, and at the same time, adjustable transversely relative to the tank.

The invention also provides for a system structured and arranged to harden rails by cooling, in a cooling medium, at least one part of a respective rail cross-section of a rail over an entire length of the rail, wherein the system comprises a cross displacement device arranged in an area of a roller table, at least one positioning device, at least one coolant container containing the cooling medium, a manipulation gripper comprising a plurality of pincers and being structured and arranged to move the rail, and each pincer comprising gripping arms having centering portions configured to axially align a head portion of the rail and gripping portions configured to hold a foot portion of the rail. The system is structured and arranged to accurately insert the rail into the at least one positioning device.

The system may further comprise at least one cooling bed and the hardening rails may comprise at least one of profiled rails, rails having different cross-sectional forms, and rails having a length greater than 50 meters.

The manipulation gripper may comprise an adjusting device. The at least one coolant container may comprise one of a tank and a trough and wherein the plurality of pincers have substantially a same shape, are aligned with one another, and move at substantially a same time. The centering portions may be configured to axially align the head portion of the rail and the gripping portions may be configured to hold the foot portion of the rail while the rail remains cross-sectionally aligned. At least one of the plurality of pincers may be structured and arranged to securely retain the rail during movement and the at least one positioning device may be structured and arranged to securely retain the rail during movement. The plurality of pincers may comprise at least one of more than two pincers and pincers spaced apart by about 10 meters. One of the gripping arms of each of the plurality of pincers may be at least one of movable and adjustable at a same time. The manipulation gripper may at least one of be coupled to a gripper movement arrangement and is movable transversely to and from a position over the roller table and be structured and arranged to move down vertically such that the gripper arms pass between rollers of the roller table to grip the rail.

The invention also provides for a system structured and arranged to harden rails by cooling, in a cooling medium, at least one part of a respective rail cross-section of a rail over an entire length of the rail, wherein the system comprises a cross displacement device arranged in an area of a roller table, at least one coolant container containing the cooling medium, a manipulation gripper structured and arranged to move the rail, and at least one positioning device comprising substantially horizontally aligned holding components having fittings structured and arranged to support a foot portion of the rail such that the rail hangs from the fittings.

The system may further comprise at least one cooling bed, wherein the at least one positioning device further comprises detachable devices structured and arranged to secure the rail supported on the fittings. The detachable devices may comprise one of clamping elements and hold-down devices. The at least one positioning device may be structured and arranged to secure the rail against distortion in an axial direction of the rail. The at least one positioning device may be at least one of structured and arranged to immobilize the rail between one of the fittings and one of the detachable devices and structured and arranged to permit movement of the rail in along a longitudinal direction of the rail.

The invention also provides for a system structured and arranged to harden rails by cooling, in a cooling medium, at least one part of a respective rail cross-section of a rail over an entire length of the rail, wherein the system comprises a cross displacement device arranged in an area of a roller table, a manipulation gripper structured and arranged to move the rail, at least two coolant containers horizontally arranged substantially adjacent and parallel to one another, each coolant container being oriented in an axial direction and containing the cooling medium, and at least one positioning device arranged in an area of each coolant container.

The system may further comprise a cooling bed, wherein the at least one positioning devices are arranged at a substantially same level. At least one of a coolant level of the coolant medium is such that a portion of the rail which will experience hardening can extend down into the cooling medium, a coolant level of the coolant medium is such that the rail extend into the cooling medium at least completely, a coolant level of the coolant medium is such that the rail extend into the cooling medium by a predetermined amount, and a coolant level of the coolant medium is such that the rail extend into the cooling medium completely and by an additional 10% relative to a vertical thickness of the rail.

Each coolant container may comprise at least one of at least one cooling medium inlet for about every 1.5 meters in coolant container length that allows passage there through of the cooling medium, at least one plate adapted to allow passage there through of the cooling medium and being arranged in each coolant container above each cooling medium inlet, a plate with nozzles, a drainage device for draining the cooling medium, and feed lines for draining the cooling medium.

The invention also provides for a system structured and arranged to harden rails by cooling, in a cooling medium, at least one part of a respective rail cross-section of a rail over an entire length of the rail, wherein the system comprises a cross displacement device arranged in an area of a roller table, at least one coolant container containing the cooling medium, a manipulation gripper structured and arranged to move the rail, at least one positioning device comprising fittings and detachable clamping devices structured and arranged to support a foot portion of the rail such that the rail hangs from the fittings. The at least one positioning device is vertically movable and/or adjustable in a controlled manner.

The system may further comprise a cooling bed and the at least one positioning device may comprise components which are movable relative to the at least one coolant container in at least one of a horizontal direction and a vertical direction.

The invention also provides for a method of harden rails using any of the systems described above, wherein the method comprises at least one of moving the rail from the roller table to the at least one coolant container and positioning the rail into the at least one positioning device via the manipulation gripper, as well as moving the rail into the coolant medium with the at least one positioning device.

BRIEF DESCRIPTION OF THE DRAWINGS

The present invention is further described in the detailed description which follows, in reference to the noted drawing by way of a non-limiting example of the exemplary embodiment of the present invention, wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
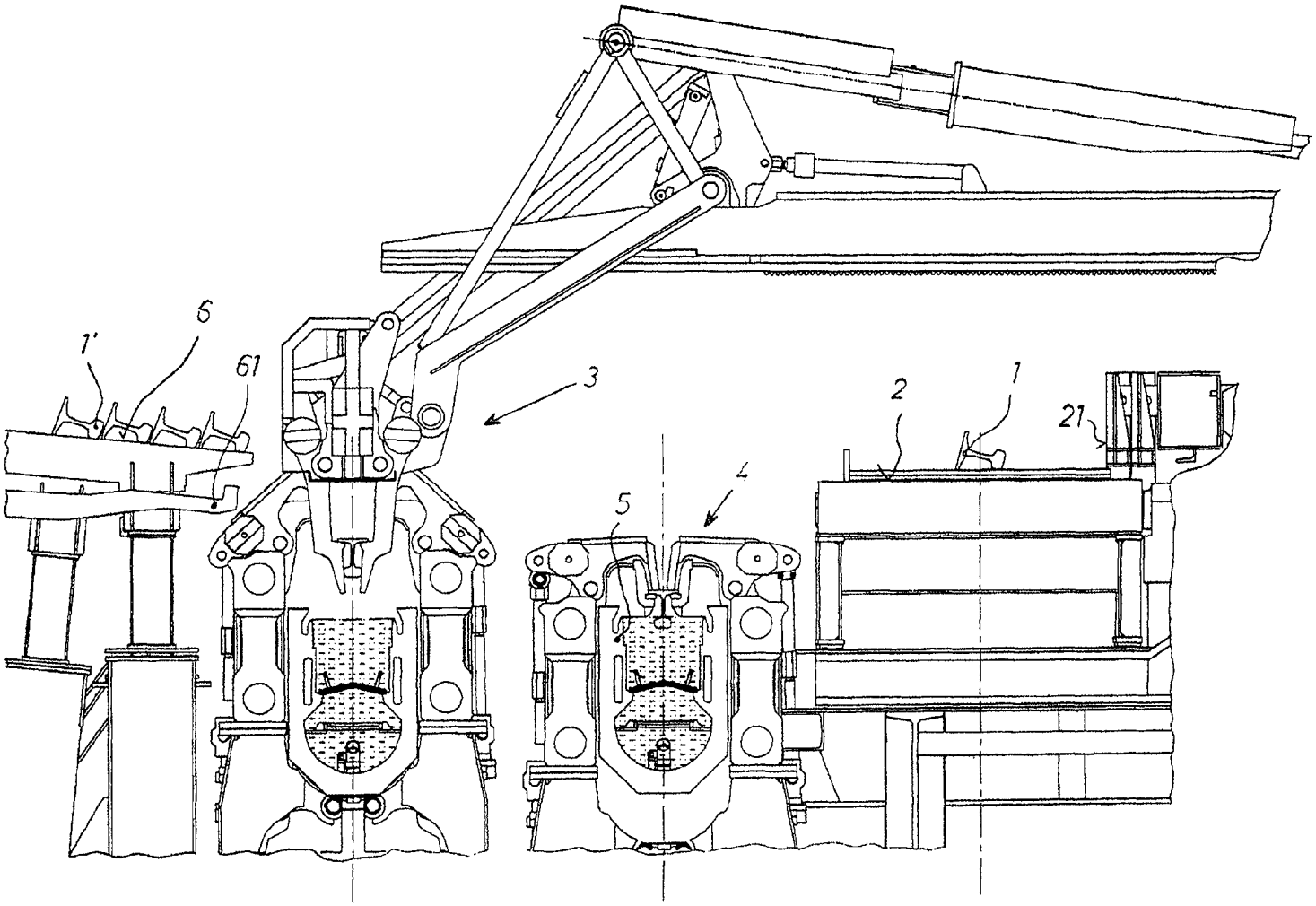
FIG. 1 shows a system for hardening rails in cross section perpendicular to the longitudinal axis of the rails.

FIG. 1 shows (in cross section) an embodiment of the invention. In operation, a rail 1 is initially placed on a roller table 2 after a pass in the last roll groove (not shown) and positioned thereon by a cross displacement arrangement 21.

Figure 2:
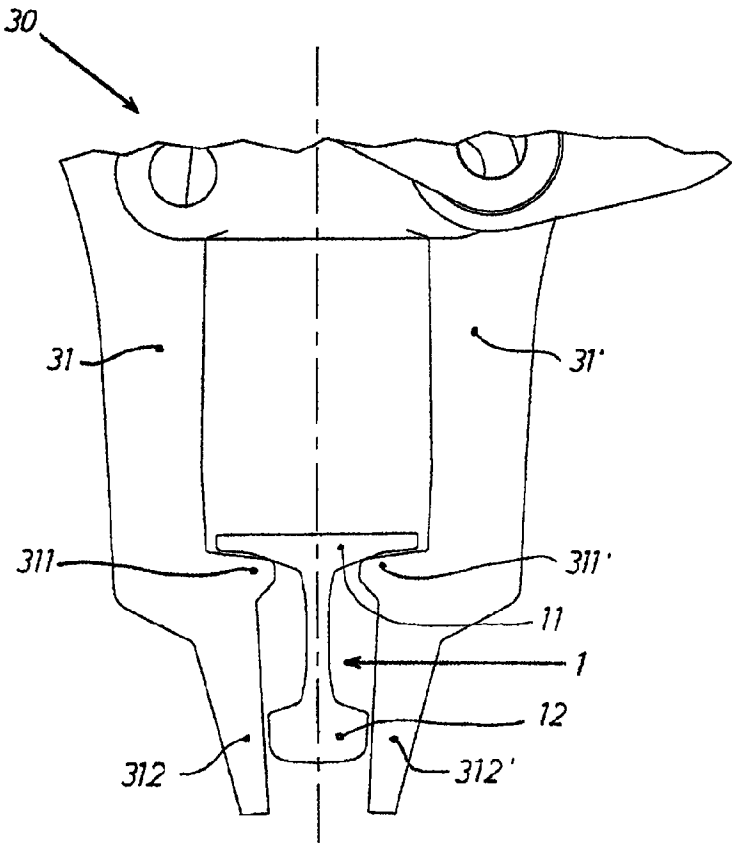
FIG. 2 shows a rail arranged in the pincers of a manipulation gripper.

While positioned on the roller table 2, the rail 1 is taken or picked up by a manipulation gripper 3. The gripper 3 has a plurality of pincers 30 which are arranged over the length of the rail 1. Each of the pincers 30 have gripping arms 31, 31' (see FIG. 2). The gripping arms 31, 31' are respectively shaped with centering parts 312, 312', which axially align a rail head portion 12 of the rail 1, and with gripping parts 311, 311' which function to hold a rail foot 11 of the rail in a hanging position. A spacing of the flange ends of the rail foot 11 from the gripping arms 31, 31' is preferably made enlarged in order to function to align different rail profiles. For example, the spacing can be such that it can align the different rail profiles 1Z, 1R, 1V shown FIGS. 4*a*, 4*b* and 4*c*. This can occur axially on the head side via the centering parts 312, 312' of the pincers 30.

Figure 3:
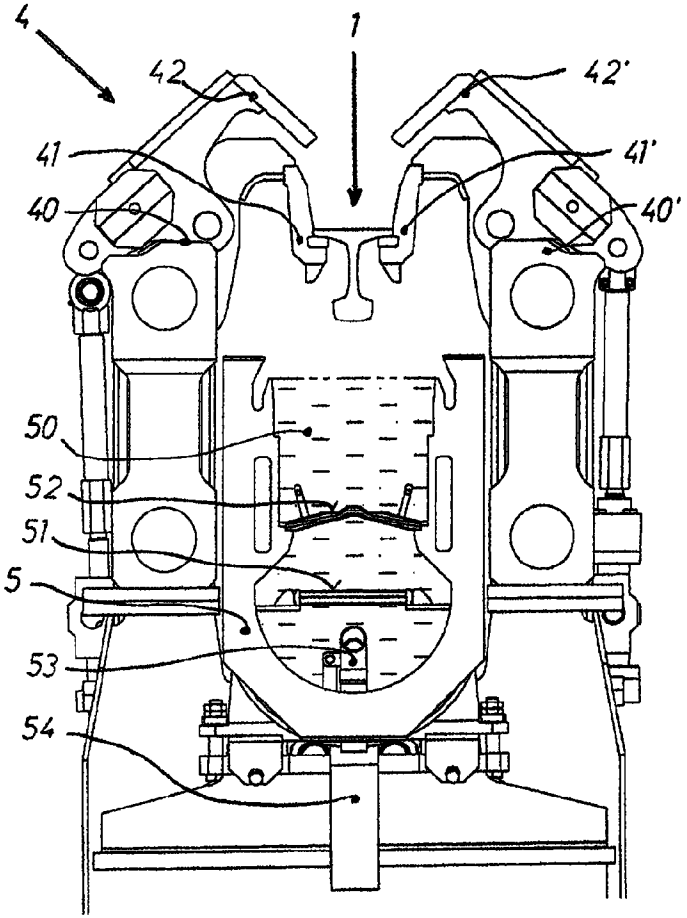
FIG. 3 shows a positioning device and tank oriented perpendicular to the longitudinal axis of the rail.

The manipulation gripper 3 shown in FIG. 1 is preferably embodied such that it takes or picks up, with positional accuracy, the rail 1 while the rail is in a lying position on the roller table 2. From the roller table 2, the gripper 3 uses the plurality of pincers 30 arranged over the length of the rail to align to axially grip the rail 1 and holds the rail 1 with the gripping arms 31, 31'. The pincers 30 are jointly moveable (e.g., mechanically and simultaneously) and provide clamping via the centering parts 312, 312'. The rail 1 can thus be moved perpendicular to the rail axis as follows; vertically, horizontally and in a rotational manner. In this way, a rail lying laterally is picked up from the roller table 2, axially aligned, rotated in a hanging position such that foot surface is oriented substantially horizontally, and inserted into a positioning device 4. As shown in FIG. 3, the rail 1 can be placed or supported on fittings 41, 41' after being placed therein vi the gripper 3.

In the same manner, as shown in FIG. 1, the rails 1, 1' can be taken up from the roller table 2 or from the positioning device 4 and placed on a cooling bed 6 or on a transfer arrangement 61.

The positioning device 4 shown in FIG. 3 has holding components 40, 40' arranged over a length of the rail 1. These components 40, 40' utilize installations or fittings 41, 41' to place the rail 1 in axially aligned manner. Clamping elements 42, 42' are utilized to engage the flange ends of a rail foot 11 and are moved during clamping in the direction towards the installations 41, 41'. The positioning device(s) 4 and tank(s) 5 having the cooling medium 50 are thus configured to interact with one anther during the hardening operation of rails 1.

Again, with reference to FIG. 1, at least two tanks 5 with cooling medium 50 are preferably arranged next to one another in a substantially axially parallel manner. The part of the cooling medium 50 that can be used for a hardening of the rail 1 in the tank 5 preferably has a depth that is greater than a maximum rail height in order to make it possible to both partially and fully immerse the rail 1 into the cooling medium 50.

As shown in FIG. 3, cooling medium inlets 54 and cooling medium deflection devices 53 are arranged in the tank 5 at a base thereof. The system can allow for a homogenizing of the flow rate of the cooling medium 50 when flowing onto the rail 1 over the entire length of the tank 5. The coolant medium 50 can also flow over the plates 51 and through the same. Nozzle plates 52 can be utilized additionally and/or alternatively for flowing the cooling medium 50.

The positioning device(s) 4 and the tank(s) 5 with cooling medium 50 interact, as previously mentioned, and can be moved relative to one another by way of one or more control devices (not shown). Using such a system, the rails 1 can be positioned for predetermined lengths of time at least in various positions such as; "immersion of specific cross-sectional parts" and/or "head hardening" and/or "full circumference immersion hardening."

Figure 4A:
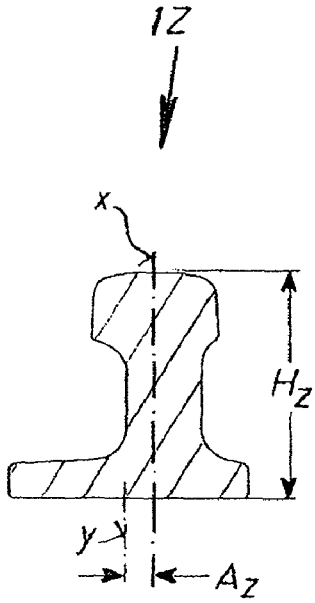
FIGS. 4*a-c* show three different cross-sectional profiles of rails.
Figure 4B:
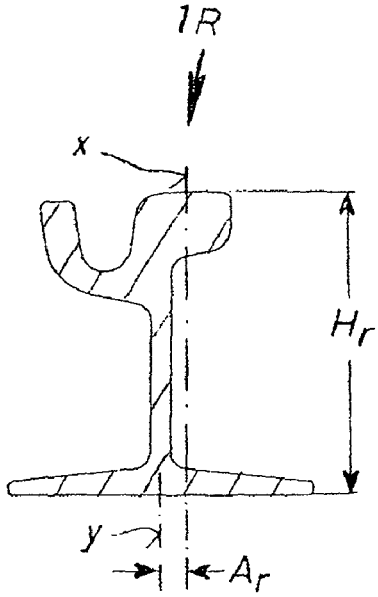
Figure 4C:
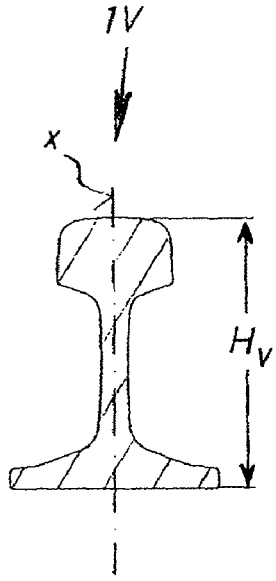

By way of non-limiting example, the system can be used for different cross-sectional profiles of rails 1, as is shown in FIGS. 4*a-c*. These can include switch rails 1Z, channel rails 1R, and bullheaded rails 1V. The system can thus accommodate axial deviations $A_Z$, $A_R$ between a head axis x and a foot axis y. The system can also accommodate the different rail heights Hz, Ht and Hv. In order to expose (respectively independently of the cross-section profile) the main mass of a rail head 12 in the immersion tank 5 to an approach flow of cooling medium 50, a horizontal axially parallel positioning of the positioning device 4 and tank 5 can be set to correspond to the axial deviations $A_Z$, $A_R$.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The list of reference numbers below is designed to facilitate the overview regarding the functional parts of the device:

1 Rail
11 Rail foot
12 Rail head
1Z Switch rail
1R Channel rail
1V Bullheaded rail
Y Foot center axis
X Head center axis
A Axial deviation
H Rail height
2 Roller table
21 Cross displacement device
3 Manipulation gripper
30 Pincers
31, 31' Gripping arms
311, 311' Gripping parts
312, 312' Centering parts
4 Positioning device
40, 40' Holding components
41, 41' Fittings
42, 42' Clamping elements
5 Tank (trough)
50 Cooling medium
51 Plate that can be flowed through

52 Nozzle plate
53 Cooling medium deflection device
54 Cooling medium inlet
6 Cooling bed
61 Transfer arrangement

What is claimed:

1. A system structured and arranged to harden rails by cooling, in a cooling medium, at least one part of a respective rail cross-section of a rail over an entire length of the rail, the system comprising:

a cross displacement device arranged in an area of a roller table;

at least one positioning device;

at least one coolant container containing the cooling medium;

a manipulation gripper comprising a plurality of pincers and being structured and arranged to move the rail; and each pincer comprising gripping arms having centering portions configured to axially align a head portion of the rail and gripping portions configured to hold a foot portion of the rail, wherein the system is structured and arranged to accurately insert the rail into the at least one positioning device.

2. The system of claim 1, further comprising at least one cooling bed, wherein the hardening rails comprise at least one of:

profiled rails;

rails having different cross-sectional forms; and rails having a length greater than 50 meters.

3. The system of claim 1, wherein the manipulation gripper comprises an adjusting device.

4. The system of claim 1, wherein the at least one coolant container comprises one of a tank and a trough and wherein the plurality of pincers have substantially a same shape, are aligned with one another, and move at substantially a same time.

5. The system of claim 1, wherein the centering portions are configured to axially align the head portion of the rail and wherein the gripping portions are configured to hold the foot portion of the rail while the rail remains cross-sectionally aligned.

6. The system of claim 1, wherein at least one of:

the plurality of pincers are structured and arranged to securely retain the rail during movement; and the at least one positioning device is structured and arranged to securely retain the rail during movement.

7. The system of claim 1, wherein the plurality of pincers comprises at least one of:

more than two pincers; and pincers spaced apart by about 10 meters.

8. The system of claim 1, wherein one of the gripping arms of each of the plurality of pincers is at least one of movable and adjustable at a same time.

9. The system of claim 1, wherein the manipulation gripper at least one of:

is coupled to a gripper movement arrangement and is movable transversely to and from a position over the roller table;

is structured and arranged to move down vertically such that the gripper arms pass between rollers of the roller table to grip the rail.

10. A method of harden rails using the system of claim 1, the method comprising:

at least one of:

moving the rail from the roller table to the at least one coolant container;

positioning the rail into the at least one positioning device via the manipulation gripper; and moving the rail into the coolant medium with the at least one positioning device.

* * * * *